US006561072B1

(12) United States Patent
Laine et al.

(10) Patent No.: US 6,561,072 B1
(45) Date of Patent: May 13, 2003

(54) DECOY DEVICE

(75) Inventors: Loïc Y Laine, Saint-Doulchard (FR); Eric J C Jouseau, Bourges (FR); Christophe S Boffano, Bourges (FR)

(73) Assignee: GTAT Industries, Versailles (FR)

( * ) Notice: Subject to any disclaimer, the term of this patent is extended or adjusted under 35 U.S.C. 154(b) by 0 days.

(21) Appl. No.: 09/558,626

(22) Filed: Apr. 26, 2000

(30) Foreign Application Priority Data

May 5, 1999 (FR) ..... 99 06380

(51) Int. Cl.[7] ..... B64D 1/04
(52) U.S. Cl. ..... 89/1.13; 89/36.07; 102/402
(58) Field of Search ..... 89/1.13, 36.07; 102/402; 273/348.1

(56) References Cited

U.S. PATENT DOCUMENTS 4,240,212 A * 12/1980 Marshall et al. ..... 434/11
4,346,901 A 8/1982 Booth
4,405,132 A * 9/1983 Thalmann ..... 273/348.1
4,422,646 A * 12/1983 Rosa ..... 273/348.1
4,546,983 A * 10/1985 Rosa ..... 273/348.1
4,659,089 A * 4/1987 Rosa ..... 273/348.1
4,814,585 A 3/1989 Klein
H679 H 9/1989 Czajkowski, Jr.
H694 H 10/1989 Czajkowski, Jr.
5,452,639 A * 9/1995 Aulenbacher et al. ..... 89/1.13
5,814,754 A 9/1998 Mangolds
5,856,629 A * 1/1999 Grosch et al. ..... 89/1.13
5,869,967 A * 2/1999 Straus ..... 324/326
5,901,959 A * 5/1999 Tessiot ..... 273/348.1
6,128,999 A * 10/2000 Sepp et al. ..... 89/36.17
6,257,262 B1 * 7/2001 Anitole ..... 135/123
6,337,475 B1 * 1/2002 Migliorini ..... 250/208.1
6,338,292 B1 * 1/2002 Reynolds et al. ..... 89/1.11

FOREIGN PATENT DOCUMENTS

EP 0829697 A2 * 3/1998 ..... F41J/2/02
FR 2 748 560 A1 11/1997

* cited by examiner

*Primary Examiner*—Charles T. Jordan
*Assistant Examiner*—M. Thomson
(74) *Attorney, Agent, or Firm*—Oliff & Berridge, PLC

(57) ABSTRACT

A decoy device, notably for a roadside mine, comprising at least one flag fastened to a support, such flag incorporating at least one part ensuring the emission of radiation in the infrared spectrum. The flag is constituted by at least one flexible panel carrying at least one heating element.

19 Claims, 4 Drawing Sheets

DECOY DEVICE

BACKGROUND OF THE INVENTION

The technical scope of the present invention is that of decoy devices, notably for roadside mines.

Such decoy devices are placed at the head of a column of vehicles or tanks. Their aim is to cause the mines to be triggered at a distance from the combat vehicles so as to be able to free a passageway.

A demining system is known by patent FR-2748560 that allows landmines that are laid, buried or placed by the roadside to be triggered.

This system is constituted by a small remotely-controlled vehicle that carries needle-like rods on its front part that are driven into the ground to ignite pressure sensitive mines. This vehicle also incorporates decoy means allowing the generation of an infrared signature close to that of a tank. Such an arrangement allows roadside mines (horizontal-action mines) that are generally fitted with infrared sensors to be triggered off.

The infrared decoy means described comprise a device that directs the exhaust gases from the vehicle's engine towards upper and/or side areas of the vehicles so as to warm them.

The disadvantage of such an arrangement lies in that the demining vehicle causes the roadside mine to detonate directly onto it. This results in the more or less total destruction of the demining vehicle, thereby obliging it to be replaced or repaired involving a long and costly intervention directly in the theatre of operations and in the midst of a mined area.

SUMMARY OF THE INVENTION

The aim of the invention is to propose a decoy device that does not suffer from such drawbacks.

Thus, the decoy device according to the invention reliably ensures the triggering of roadside mines whilst avoiding the destruction of the decoy vehicle.

This results in a quicker and less costly demining operation.

Thus, the subject of the invention is a decoy device, notably for a roadside mine, characterised in that it comprises at least one flag fastened to a support, such flag incorporating at least one part ensuring the emission of radiation in the infrared spectrum.

According to a first embodiment, the flag can be constituted by at least one flexible panel carrying at least one heating element.

The heating element or elements can be connected to temperature-controlling means.

At least one heat sensor can be placed in the vicinity of the heating element and can be connected to the temperature-controlling means.

The heating element can incorporate at least one flexible conductive element fastened at a first part of the panel and made in a curve whose shape, when the heat element is operating, ensures the production of a thermal gradient between the first part and a second part of the panel.

The curve formed by the flexible conductive element can be a damped sinusoid.

Advantageously, the flag can be made of a rollable flexible material and the support can incorporate at least one roller.

According to another embodiment, the flag can be constituted by at least three flexible bands, at least one of the bands being fitted with a heating element.

The temperature of each heating element carried by a band can be controlled at a different value for each band.

The heating element of each band can incorporate at least one conductive element extending longitudinally between an upper edge and a lower edge of the band.

Each band can incorporate a temperature sensor.

According to another embodiment, the flag can be constituted by making at least three plates integral with one another, one plate at least carrying a heating element.

The plates can be connected together by removable connecting means.

All the plates placed in at least one area of the flap will preferably be fitted with heating elements connected to means to regulate the temperature, the temperature of each plate being able to be regulated individually.

Whatever the case, the flag will be constituted by or covered by a light-reflective material.

The reflective material can be formed by at least one metallized layer.

The flag can be fastened to a support in the form of a bracket integral with a front part of a vehicle, said flag carrying at least one weight integral with a lower edge.

The vehicle can be remotely-controlled and can carry means to generate an acoustic and/or seismic signal.

BRIEF DESCRIPTION OF THE DRAWINGS

Other advantages of the invention will become apparent after reading the following description made of the different embodiments, such description being made with reference to the appended drawings, in which.

DETAILED DESCRIPTION OF PREFERRED EMBODIMENTS

Figure 1:
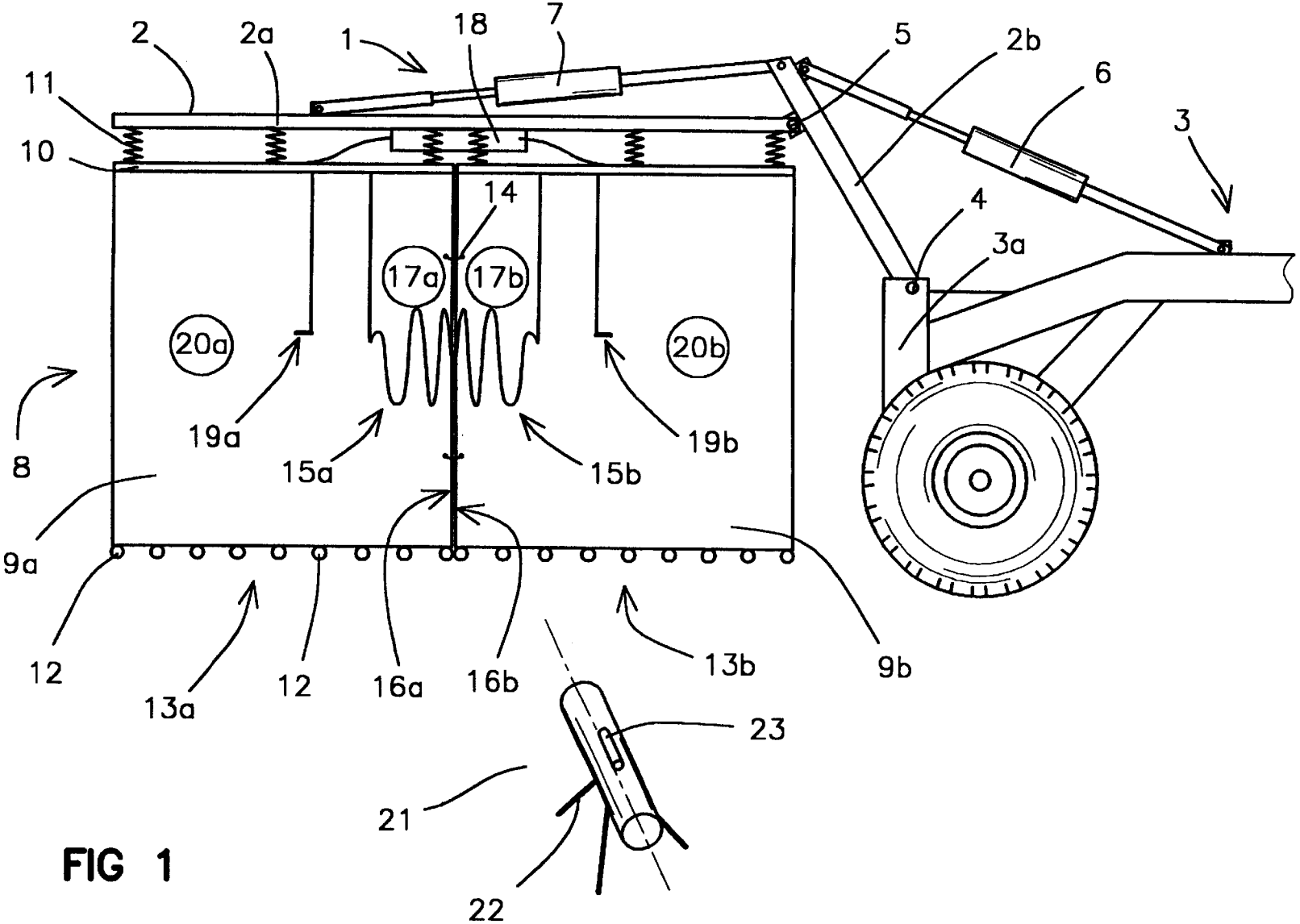
FIG. 1 shows a decoy device according to a first embodiment of the invention.

With reference to FIG. 1, the decoy device 1 according to a first embodiment comprises a support 2 that is in the shape of a bracket comprising a horizontal arm 2*a* connected by a first joint 5 to an inclined arm 2*b*.

The inclined arm 2*b* is fastened by means of a second joint 4 to a front part 3*a* of a vehicle 3, the front wheels of which are only shown here.

A first hydraulic jack 6 allows the angle between the inclined arm 2*b* and the front part 3*a* of the vehicle to be regulated.

A second hydraulic jack 7 allows the angle between the horizontal arm 2*a* and the inclined arm 2*b* to be regulated.

In accordance with the invention, the support 2 carries a flag 8 that is here constituted by two flexible panels 9*a*, 9*b*.

Each panel 9*a*, 9*b* is integral with an upper rod 10 that is suspended from the horizontal arm 2*a* by means of flexible linking means 11, for example springs.

Each panel is square-shaped and measures 2 m at its sides. It also carries weights 12 integral with its lower edge 13*a*, 13*b*.

Thus the panels are evenly stretched by the weights 12 and form a substantially plane and vertical surface suspended on the bracket 2.

The jacks 6 and 7 allow the position of the flag 8 to be regulated with respect to the ground.

The flatness of the flag is reinforced by staples 14 that provide a link between the panels.

The panels are made from a sheet of plastic material or are woven at a thickness of a few tenths of mm, they have a light-reflective surface on each face, such surface being obtained, for example by metallization.

Each panel incorporates a heating element 15*a,* 15*b* that is formed by a flexible conductive element that is attached at a first part 17*a,* 17*b* of the panel, located substantially in the middle of side 16*a,* 16*b* of the panel 9*a,* 9*b* that is in contact with the neighbouring panel and carries fastening staples 14.

The conductive elements are made, for example, by screen printing of an electrically conductive composition or by fastening flexible metallic conductors onto the panel surface. If the constitutive material of the panel is a good heat insulator, a heating element can also be placed on each face of the panel so as to ensure that the infrared rays are emitted from both sides of the panel.

The heating elements 15*a* and 15*b* are independently connected to a power source that forms a temperature control means 18 for the conductive elements.

The control means 18 comprises a power generator allowing the voltage to be controlled.

Temperature control will be provided by the control means 18 based on a pre-programming of the desired temperatures (memorised in means 18), and takes a reading of the actual temperature of panels 9*a,* 9*b* obtained by the temperature sensors 19*a,* 19*b* that are also connected to the control means 18.

The temperature sensors are, for example, thermistors or thermocouples.

According to another characteristic of the invention, the heating elements 15*a,* 15*b* are in a shape that, when the heating element is operating, ensure the production of a thermal gradient between the first part 17*a,* 17*b* of the panel and a second peripheral part 20*a,* 20*b* of the panel.

This shape is here substantially a damped sinusoidal curve whose amplitude is maximal at the side 16*a,* 16*b* of the panel and decreases as the heating element moves away from this side.

Such a conductor shape results in a greater heating element length at the first part 17*a,* 17*b* of the panel that in the vicinity of the peripheral part 20*a,* 20*b*. The temperature obtained will thus be greater in the first part 17*a,* 17*b* than in the rest of the panel.

This results (from the point of view of the infrared radiation emitted by the heating elements 15*a,* 15*b*) in the appearance of a hot point at parts 17*a,* 17*b,* that is, substantially in the middle of the flag 8 formed by the two panels 9*a,* 9*b,* as well as a temperature gradient around this hot point.

The control means 18 will be regulated so as to obtain a temperature at the central area 17*a,* 17*b* of the flag 8 that is between 5° and 10° higher that the ambient temperature over a surface area of around 0.5 $m^2$.

The emissivity of the flag 8 in the infrared domain is thus close to that of an armoured vehicle.

The power consumption of such a device is of around a few tens of watt-hours, the vehicle's batteries being enough to ensure the supply of such power.

The shape of the conductors will be selected so as to ensure the required temperature rate. The temperature sensors 19*a,* 19*b* will allow the temperature rate to be controlled.

The flag according to the invention constitutes a decoy for a roadside mine 21. Such a mine is usually placed on a tripod 22 along a travel route for armoured vehicles. It incorporates a target sensor 23 that generally associates infrared detection and a laser range finder.

When the device according to the invention moves in front of the target sensor 23 of the mine 21, the latter detects a hot point whose infrared signature is close to that of a vehicle. The laser beam of the range finder is reflected back by the metallized surface of the panels 9*a,* 9*b,* which, to the mine, confirms the presence of a target of a length equivalent to that of a combat vehicle.

The mine 21 is thus triggered off by the decoy device according to the invention.

The flexible panels 9*a,* 9*b* are lightweight and inexpensive, they can be easily replaced after being destroyed by the mine, and the demining vehicle retains its full mobility. The panels can moreover be thin enough so as not to trigger the detonation of the projectile fired by the mine upon impacting on the flag.

By way of a variant, a device can be defined in which the flag would be formed of a single panel.

Advantageously, one or several roller systems can be provided integral with the support enabling each panel to be rolled up. The rollers will preferably be motorised. Rolling is made possible by the suppleness of the constitutive material of the panels. The mobility of the device is thereby made easier, the panels being able to be easily deployed or folded up. The deployed length of each panel can also be modified.

By way of a variant, each panel can be made in the form of a sheet of heat-conductive polymer onto which a flexible conductive mesh has been applied. This structure will be covered on both its faces by a reflective protective sheet (for example, a metallized plastic material).

This structure will be easy to roll up.

A device incorporating a first heated panel (to a temperature of between 5° and 10° above the ambient temperature) can be made that is followed by a second, unheated, panel (but with reflective capabilities).

Figure 2:
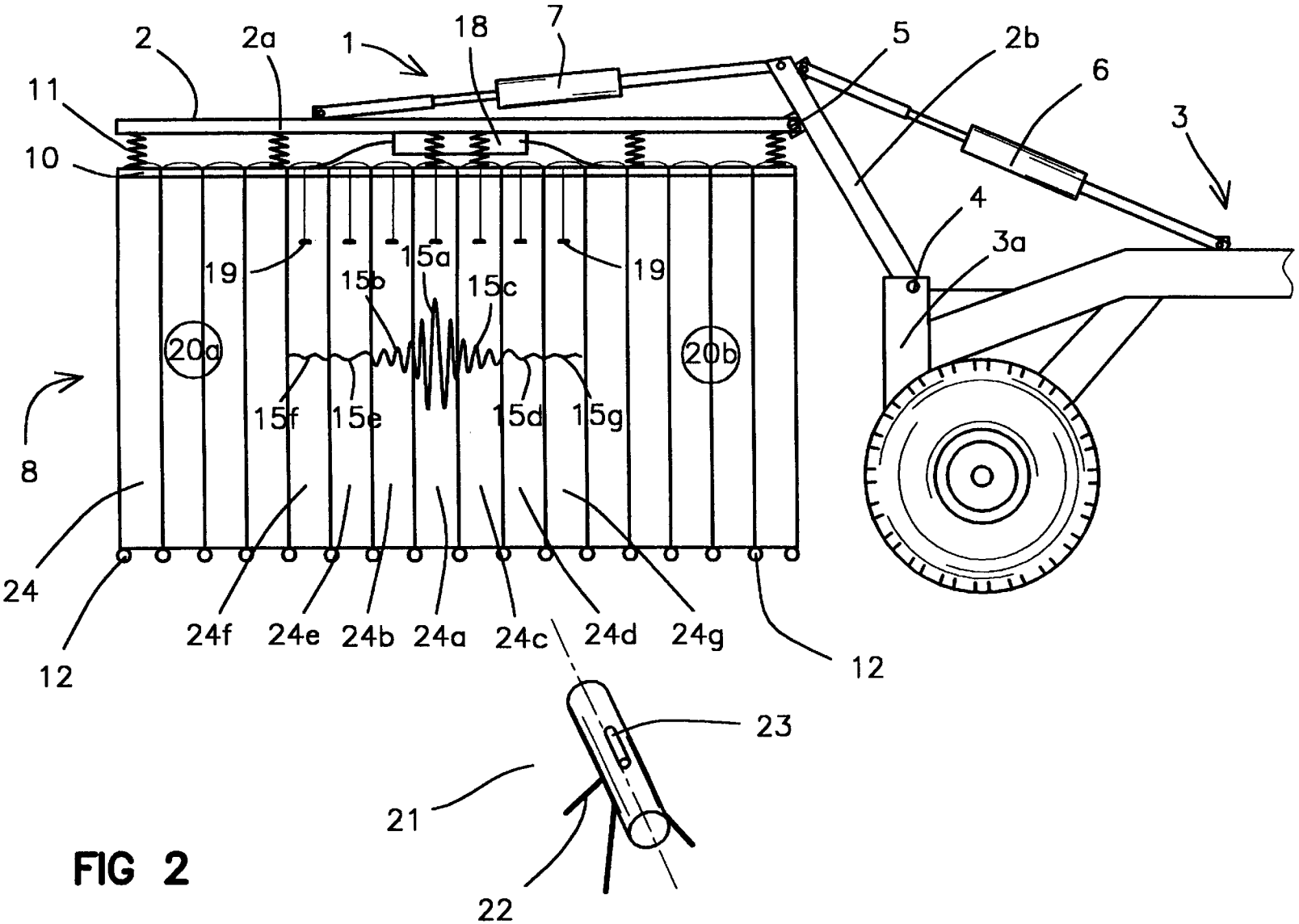
FIG. 2 shows a decoy device according to a second embodiment of the invention.

FIG. 2 shows a decoy device according to a second embodiment of the invention.

This device differs from the previous one in the structure of the flag 8 that here is not formed by two panels but by the juxtaposing of several rectangular bands 24 such as for a flexible curtain. Each band is metallized on both its faces to ensure that it is reflective.

It is suspended by its upper edge from the rod 10 and carries weights 12 attached to its lower edge. The bands are of a reduced length (around 150 mm) for a length in the region of 2 m. Such a configuration allows a more flexible flag 8 to be obtained and can notably better adapted itself to ground irregularities.

In accordance with the invention, certain of the bands 24 carry a heating element 15 constituted by a flexible conductive element bonded or screen printed onto the surface of the band (and possibly symmetrically on the two faces of each band so as to ensure infrared emissivity of the same rate on either side of the flag).

On FIG. 2, only bands 24*a,* 24*b,* 24*c,* 24*d,* 24*e,* 24*f,* and 24*g* carry a heating element (respectively 15*a,* 15*b,* 15*c,* 15*d,* 15*e,* 15*f,* and 15*g*).

Each heating element 15 is connected to the control means 18 ensuring its temperature control.

The heating surface of the heating elements 15 is different according to the band in question. Thus central band 24*a* carries a heating element 15*a* whose length is greater that that of the heating elements carried by neighbouring bands 24*b* and 24*c*. Peripheral bands 24*f* and 24*g* are those for which the heating elements is of a minimal length. The central band can thus be brought to a temperature higher than that of the side bands.

Globally, the curve formed by juxtaposing the different heating elements is here substantially the shape of a damped sinusoid on either side of the central band 24*a*.

Each band 24 can also carry a temperature sensor 19 that is connected to the control means 18 and that allows the actual temperature of the band in question to be measured.

The temperature of each heating element carried by a band is regulated by the control means 18 at a different value for each band.

Such a configuration results in a temperature for the central band that is higher than that of the side bands and there is thus a thermal gradient between the central band 24*a* and the side bands.

This device operates in the same way as the one previously described. The mine sensor 23 will detect a hot point at a central part 17 of the flag. The range finder laser will be reflected back by the surface of the bands and the mine will be ignited.

In addition to its improved adaptability to the ground, this embodiment has the advantage of being easily repairable after a mine has been triggered. Indeed, more often than not, only a single band destroyed by the mine will have to be replaced, which is easier and less expensive that replacing all the decoy flag.

By way of a variant, the bands incorporating the hottest parts can be placed to the rear so as to simulate vehicles whose hot point is the exhaust pipe (located to the rear).

Figure 3:
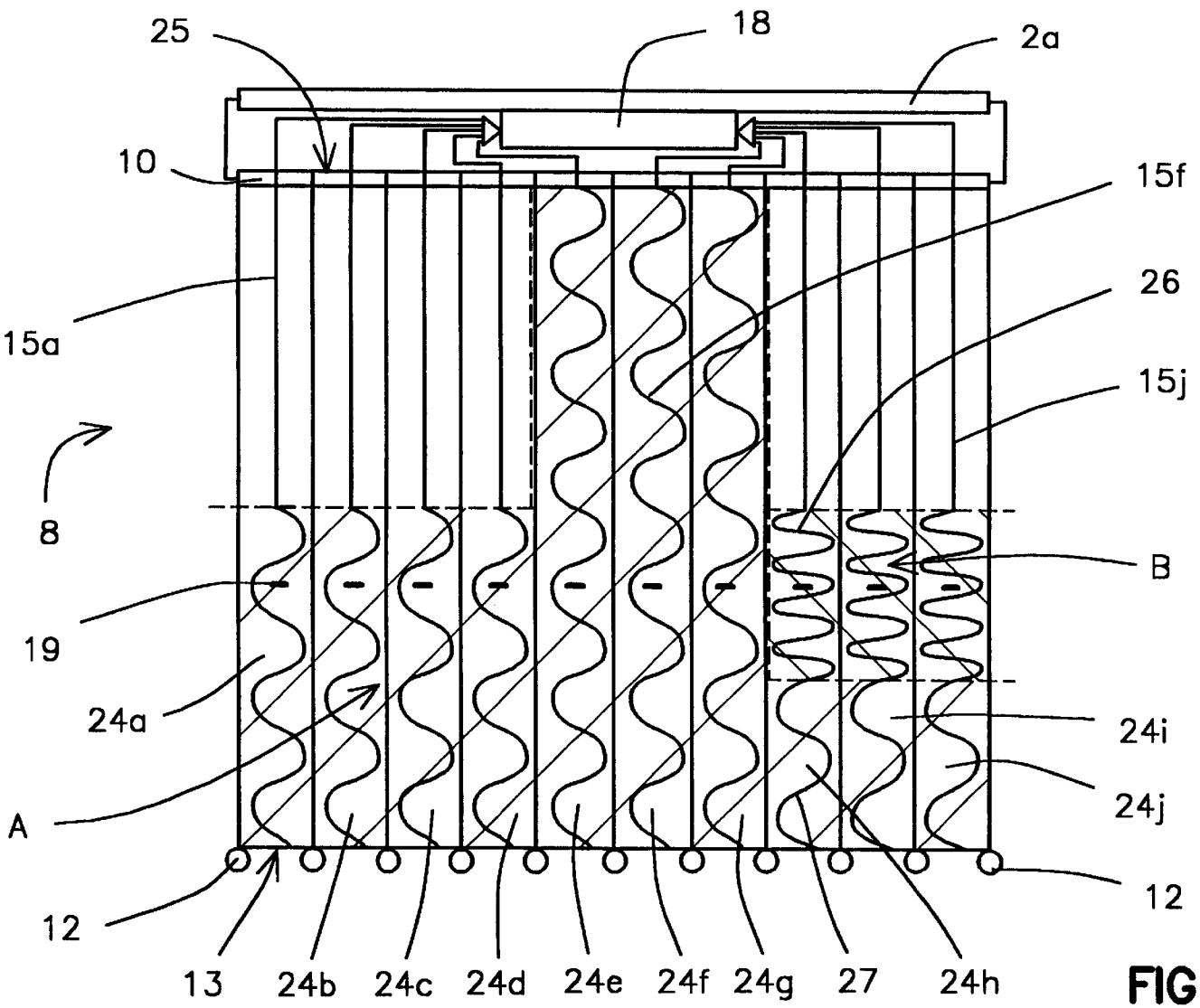
FIG. 3 shows a variant of the decoy device according to the second embodiment.

FIG. 3 shows a variant embodiment in which each band 24 carries at least one flexible conductive element 15 that extends longitudinally between an upper edge 25 and a lower edge 13 of the band 24 and that has at least one undulation. The band will possibly carry two symmetrical conductors, one on either face.

The flag 8 here incorporates ten bands numbered 24*a* to 24*j*. The central bands 24*e*, 24*f* and 24*g* have conductors 15 that are evenly undulated over substantially all the length of the band.

The front bands 24*a*, 24*b*, 24*c* and 24*d* have conductors 15 that are only evenly undulated over the lower half of the band.

The rear bands 24*h*, 24*i* and 24*j* also have conductors that are only undulated over the lower half of the band, but the undulations formed on these bands are variable in shape along each band. Narrowly spaced undulations 26 are thus replaced by wider spaced undulations 27.

Each conductive element 15 is connected to the temperature control means 18. A temperature sensor 19 being additionally placed on each band in the vicinity of the area heated by the conductive element.

Such a configuration allows two temperature zones (hatched in FIG. 3) to be delimited on the flag 8:

zone A that corresponds to the conductive elements having widely spaced undulations and that comprises bands 24*e*, 24*f* and 24*g*, the lower half of bands 24*a*, 24*b*, 24*c* and 24*d*, and the lower quarter of bands 24*h*, 24*i* and 24*j*.

zone B that corresponds to the conductive elements having narrowly spaced undulations and that comprises a quarter of bands 24*h*, 24*i* and 24*j*.

Zone B will be controlled at a temperature of between 15° and 20° above the ambient temperature and that is higher than that of zone A (which will itself be brought to a temperature of between 5° and 10° above the ambient temperature). The flag assembly thus roughly fashions the silhouette of an armoured vehicle A whose engine compartment corresponds to zone B.

The advantage of this variant lies in that it is easier for the hot point to be displaced in order to simulate different vehicles (for example, with the exhaust pipe to the rear).

Figure 4:
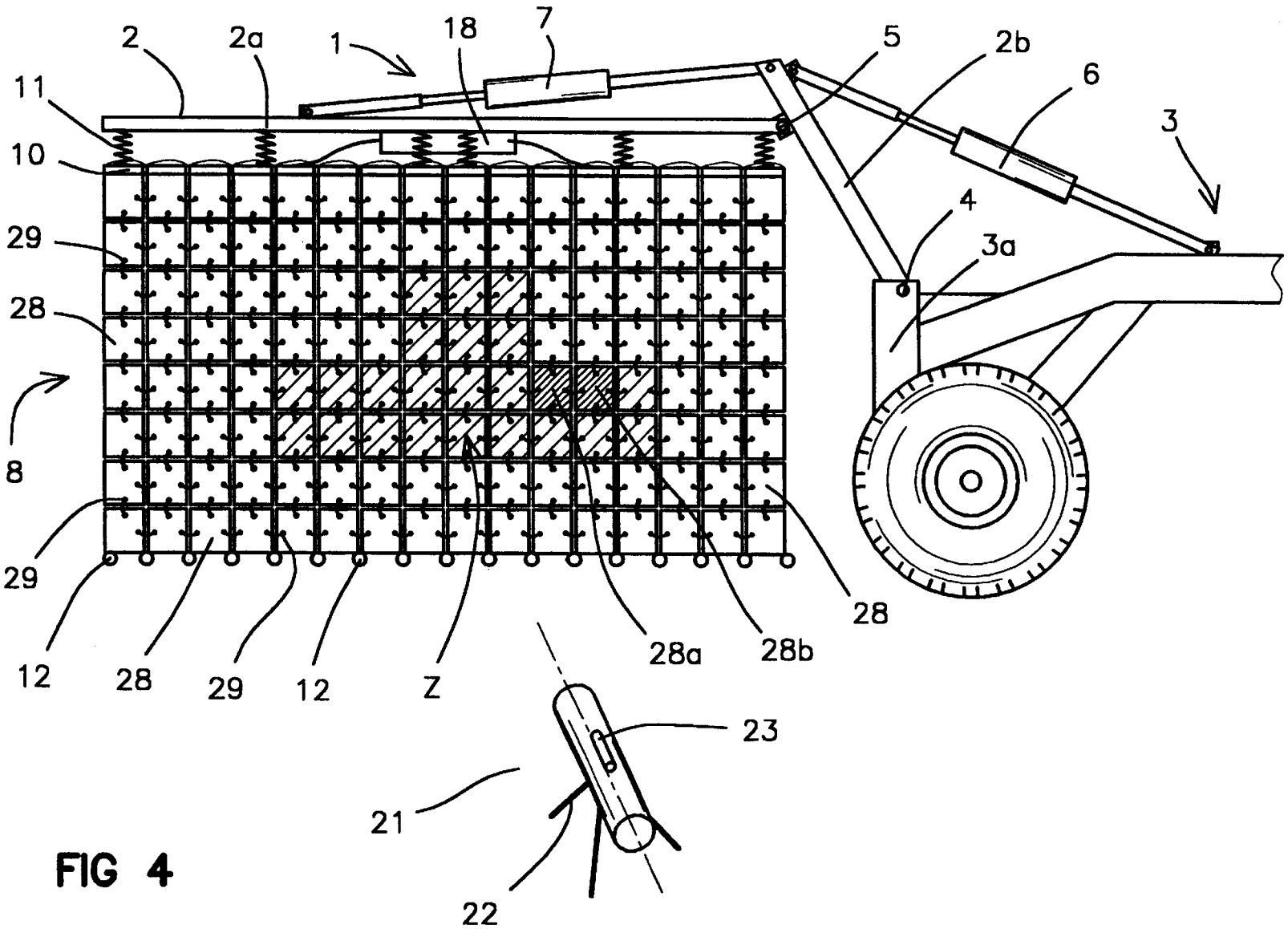
FIG. 4 shows a decoy device according to a third embodiment.

FIG. 4 shows a third embodiment of the device according to the invention.

This embodiment differs from the previous one in that the flag 8 is made by a mosaic of plates 28 that are connected together by removable linking means 29, for example repositionable rings.

The plates will be made, for example, of aluminium.

All the plates are covered with a light-reflective material and certain plates are fitted with heating elements, for example electrical resistors or conductors (not shown) arranged on either side of each plate and connected to the temperature control means 18.

Each heating plate will also carry a temperature sensor (not shown).

Using such a configuration it is possible for each plate fitted with heating means to be given a specific temperature.

The temperature of each plate can be individually controlled by means 18, it is thus possible for the flag 8 to be given an infrared signature close to that of a true vehicle. A certain number of heated plates, arranged substantially in the middle of the flag 8 and delimiting the Z shape of an armoured vehicle, have thus been shaded in FIG. 4. In this Z shape, plates 28*a* and 28*b* are heated to a temperature that is higher than that of their neighbouring plates so as to simulate the location of the engine compartment.

Once again, the detonation of the mine 21 will only cause the destruction of one or two plates that can be easily and quickly replaced.

The decoy device according to any one of the previously described embodiments can be completed by providing means carried on the vehicle 3 and enabling the generation of an acoustic and/or seismic signal. Indeed, roadside mines are frequently provided with acoustic surveillance means. The noise generated by one or several armoured vehicles merely has to be recorded and transmitted from the vehicle 3 by means of loudspeakers, for example.

By way of a variant, it would be enough to merely amplify the noise of the vehicle carrying the flag according to the invention.

The seismic signal can be obtained by using wheels or tracks integral with the vehicle and of a suitable profile.

Advantageously, the vehicle 3 can be remotely-controlled, for example, by a follow-up vehicle. The safety of the whole demining operation would thereby be improved.

The flag can also be attached to a remotely-controlled chassis. In any event, the flag must be separated from a follow-up vehicle by an empty gap so that the flag can effectively be recognised as a vehicle.

The invention can lastly be applied to other types of decoying than that of roadside mines, notably to the simulation of armoured vehicles for the protection of a site or zone against attack by infrared-guided missiles.

What is claimed is:

1. A decoy device, comprising:

a mobile support; and at least one flag fastened to and suspended from the support, such flag incorporating at least one part that emits radiation in the infrared spectrum and is moved by the support to initiate detonation of a roadside mine based on the emitted radiation.

2. A decoy device according to claim 1, characterised in that the flag (8) is constituted by at least one flexible panel (9*a,* 9*b*) carrying at least one heating element (1(*a,* 15*b*).

3. A decoy device according to claim 1, characterised in that heating element or elements (15*a,* 15*b*) are connected to a temperature-controlling means (18).

4. A decoy device according to claim 3, characterised in that at least one temperature sensor (19*a,* 19*b*) is placed in the vicinity of the heating element (15*a,* 15*b*) and is connected to the control means (18).

5. A decoy device according to claim 2, characterised in that the heating element (15*a,* 15*b*) incorporates at least one flexible conductive element (15*a,* 15*b*) fastened at a first part (17*a,* 17*b*) of the panel and made in a curve whose shape, when the heat element is operating, ensures the production of a thermal gradient between the first part and a second part (20*a,* 20*b*) of the panel.

6. A decoy device according to claim 5, characterised in that the curve is a damped sinusoid.

7. A decoy device according to claim 1, characterised in that the flag (8) is made of a rollable flexible material and the support incorporates at least one roller.

8. A decoy device according to claim 1, characterised in that the flag (8) is constituted by at least three flexible bands (24), at least one of the bands being fitted with a heating element (15).

9. A decoy device according to claim 8, characterised in that a temperature of each heating element carried by a band is controlled at a different value for each band (24).

10. A decoy device according to claim 9, characterised in that the heating element (15) of each band incorporates at least one conductive element extending longitudinally between an upper edge (25) and a lower edge (13) of the band.

11. A decoy device according to claim 8, characterised in that each band (24) incorporates a heat sensor (19).

12. A decoy device according to claim 1, characterised in that the flag (8) is constituted by making at least three plates (28) integral with one another, one plate at least carrying a heating element.

13. A decoy device according to claim 12, characterised in that the plates (28) are connected together by removable connecting means (29).

14. A decoy device according to claim 13, characterised in that all the plates (28) placed in at least one area of the flap will preferably be fitted with heating elements connected to means (18) to regulate the temperature, the temperature of each plate being able to be regulated individually.

15. A decoy device according to claim 1, characterised in that the flag (8) is constituted by or covered by a light-reflective material.

16. A decoy device according to claim 15, characterised in that the reflective material is formed by at least one metallized layer.

17. A decoy device according to claim 1, characterised in that the flag (8) is fastened to a support (2) in the form of a bracket integral with a front part (3*a*) of a vehicle (3), said flag carrying at least one eight (12) integral with a lower edge (13).

18. A decoy device according to claim 17, characterised in that the vehicle is remotely-controlled.

19. A decoy device according to claim 17, characterised in that the vehicle carries means to generate an acoustic and/or seismic signal.

* * * * *

UNITED STATES PATENT AND TRADEMARK OFFICE

CERTIFICATE OF CORRECTION

PATENT NO. : 6,561,072 B1
DATED : May 13, 2003
INVENTOR(S) : Loic Laine et al.

It is certified that error appears in the above-identified patent and that said Letters Patent is hereby corrected as shown below:

Title page,
Item [73], should read -- Assignee: GIAT Industries, Versailles (FR) --

Signed and Sealed this

Fourteenth Day of October, 2003

JAMES E. ROGAN
*Director of the United States Patent and Trademark Office*